US006840393B2

(12) United States Patent
Tu

(10) Patent No.: US 6,840,393 B2
(45) Date of Patent: Jan. 11, 2005

(54) CRANE ASSEMBLY

(76) Inventor: Hsueh-Chuan Tu, No. 46, Daming Rd., Fengyuan City, Taichung Hsien (TW)

( * ) Notice: Subject to any disclaimer, the term of this patent is extended or adjusted under 35 U.S.C. 154(b) by 155 days.

(21) Appl. No.: 10/385,816

(22) Filed: Mar. 10, 2003

(65) Prior Publication Data

US 2004/0178160 A1 Sep. 16, 2004

(51) Int. Cl.[7] ..... B66C 19/00
(52) U.S. Cl. ..... 212/328; 104/154; 212/331
(58) Field of Search ..... 212/71, 328–330, 212/336, 337; 104/154

(56) References Cited

U.S. PATENT DOCUMENTS

| | | | | | |
|---|---|---|---|---|---|
| 1,122,295 | A | * | 12/1914 | Moore | 212/346 |
| 1,325,259 | A | * | 12/1919 | Moore | 212/337 |
| 1,879,819 | A | * | 9/1932 | O'Neill | 212/336 |
| 2,974,609 | A | * | 3/1961 | Bent et al. | 105/153 |
| 3,033,383 | A | * | 5/1962 | Kittle et al. | 212/337 |
| 3,183,851 | A | * | 5/1965 | Hawks | 104/91 |
| 3,212,455 | A | * | 10/1965 | Workman | 105/155 |
| 3,310,134 | A | * | 3/1967 | Stevens, Jr. | 188/43 |
| 4,892,203 | A | * | 1/1990 | Arav | 212/331 |
| 5,074,423 | A | * | 12/1991 | Smith | 212/337 |
| 5,170,995 | A | * | 12/1992 | Bitsch et al. | 254/342 |
| 5,725,199 | A | * | 3/1998 | Yamamoto | 254/360 |
| 6,077,061 | A | * | 6/2000 | Peters et al. | 418/181 |
| 6,516,728 | B1 | * | 2/2003 | Muller et al. | 104/94 |
| 6,564,954 | B1 | * | 5/2003 | Buhlmayer et al. | 212/71 |

FOREIGN PATENT DOCUMENTS

| | | | |
|---|---|---|---|
| EP | 0 118 302 | * | 9/1984 |

* cited by examiner

*Primary Examiner*—Thomas J. Brahan
(74) *Attorney, Agent, or Firm*—Dellett & Walters

(57) ABSTRACT

A crane assembly has a bracket, a supporting plate, a crane device, a chain and a chain bag. The bracket has two side plates with wheels connected with each other. Each side plate has a first recess defined in the bottom of the side plate to make the side plate have an inverse U-shape. Two axles are mounted between the side plates and are respectively located at two sides of the first recesses in the side plates to combine the side plates together. The supporting plate is attached to the axles and is mounted between the side plates. The craning device is pivotally attached to the supporting plate and has a top portion received in the first recesses in the side plates. Accordingly, the location of the crane device is heightened, and the craning travel of the chain is prolonged.

5 Claims, 5 Drawing Sheets

CRANE ASSEMBLY

BACKGROUND OF THE INVENTION

1. Field of the Invention

The present invention relates to a crane assembly, and more particularly to a crane assembly which has a prolonged craning travel.

2. Description of Related Art

With reference to FIGS. 4 and 5, a conventional crane assembly is moveably mounted on a rail (70) which is mounted below the roof of a workshop to lift and to move a heavy object to a desired height or place. The conventional crane assembly in accordance with the prior art comprises a bracket (50), a lifting device (60), a chain (64) and a chain bag (66). The bracket (50) is moveably mounted on the rail (70) and has two side plates (52) connected with each other and respectively located two sides of the rail (70). An axle (54) is mounted between the side plates (52) to combine the side plates (52) together. Two wheels (not shown) are rotatably attached to each respective side plate (52) and abut the rail (70). A first motor (not shown) is attached to one of the side plates (52) and is connected to the wheels on the side plate (52) on which the first motor is mounted. When the first motor is switched on, the wheels will be actuated to rotate so as to make the bracket (50) move along the rail (70).

The lifting device (60) is pivotally attached to the axle (54) and is located below the bracket (52). The lifting device (60) comprises a housing (not numbered), a second motor (62) and a craning mechanism (not shown). The second motor (62) is attached to one end of the housing, and the craning mechanism is received in the housing and is connected to and actuated by the second driving motor (62). The chain (64) extends through the housing and is connected to and driven by the craning mechanism. One end of the chain (64) is provided with a hook (65), and the other end of the chain (64) is received in the chain bag (66). With such a crane assembly, a heavy object can be lifted and moved to a desired height and place.

However, because the crane device (60) is attached to the axle (54) and is located below the bracket (50), the location of the crane device (54) is low so as to shorten the craning travel of the chain (64). Especially in a place in which a roof is at a low location, the conventional crane assembly with a short craning travel is always not fitted with need of a user.

To overcome the shortcomings, the present invention tends to provide a craning assembly to mitigate or obviate the aforementioned problems.

SUMMARY OF THE INVENTION

The main objective of the invention is to provide a crane assembly that has a prolonged craning travel. The crane assembly has a bracket, a supporting plate, a crane device, a chain and a chain bag. The bracket has two side plates with wheels connected with each other. Each side plate has a first recess defined in the bottom of the side plate to make the side plate have an inverse U-shape. Two axles are mounted between the side plates and are respectively located at two sides of the first recesses in the side plates to combine the side plates together. The supporting plate is attached to the axles and is mounted between the side plates. The craning device is pivotally attached to the supporting plate and has a top portion received in the first recesses in the side plates. Accordingly, the location of the crane device is heightened, and the craning travel of the chain is prolonged.

Other objects, advantages and novel features of the invention will become more apparent from the following detailed description when taken in conjunction with the accompanying drawings.

DETAILED DESCRIPTION OF PREFERRED EMBODIMENT

Figure 1:
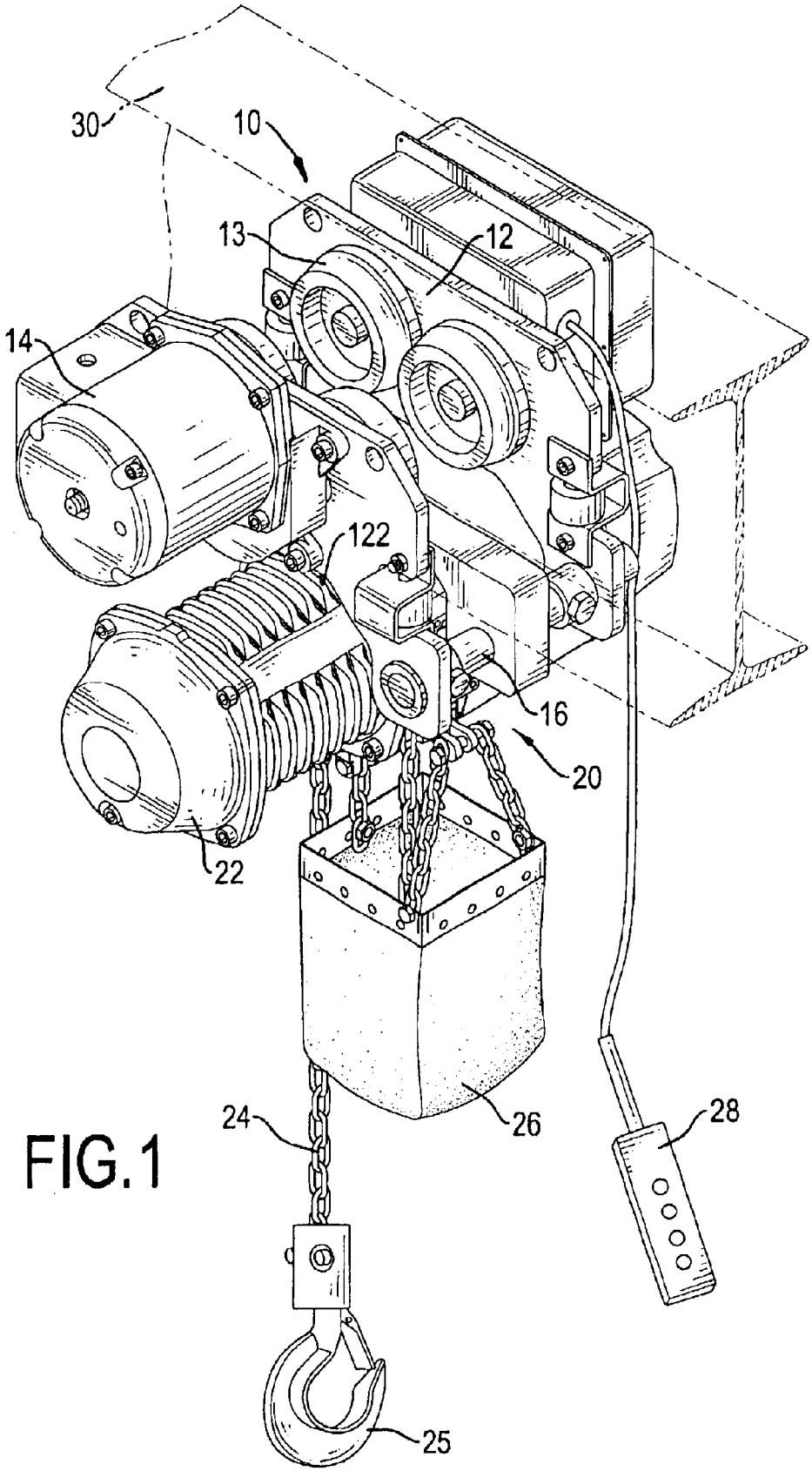
FIG. 1 is a perspective view of a crane assembly in accordance with the present invention.
Figure 2:
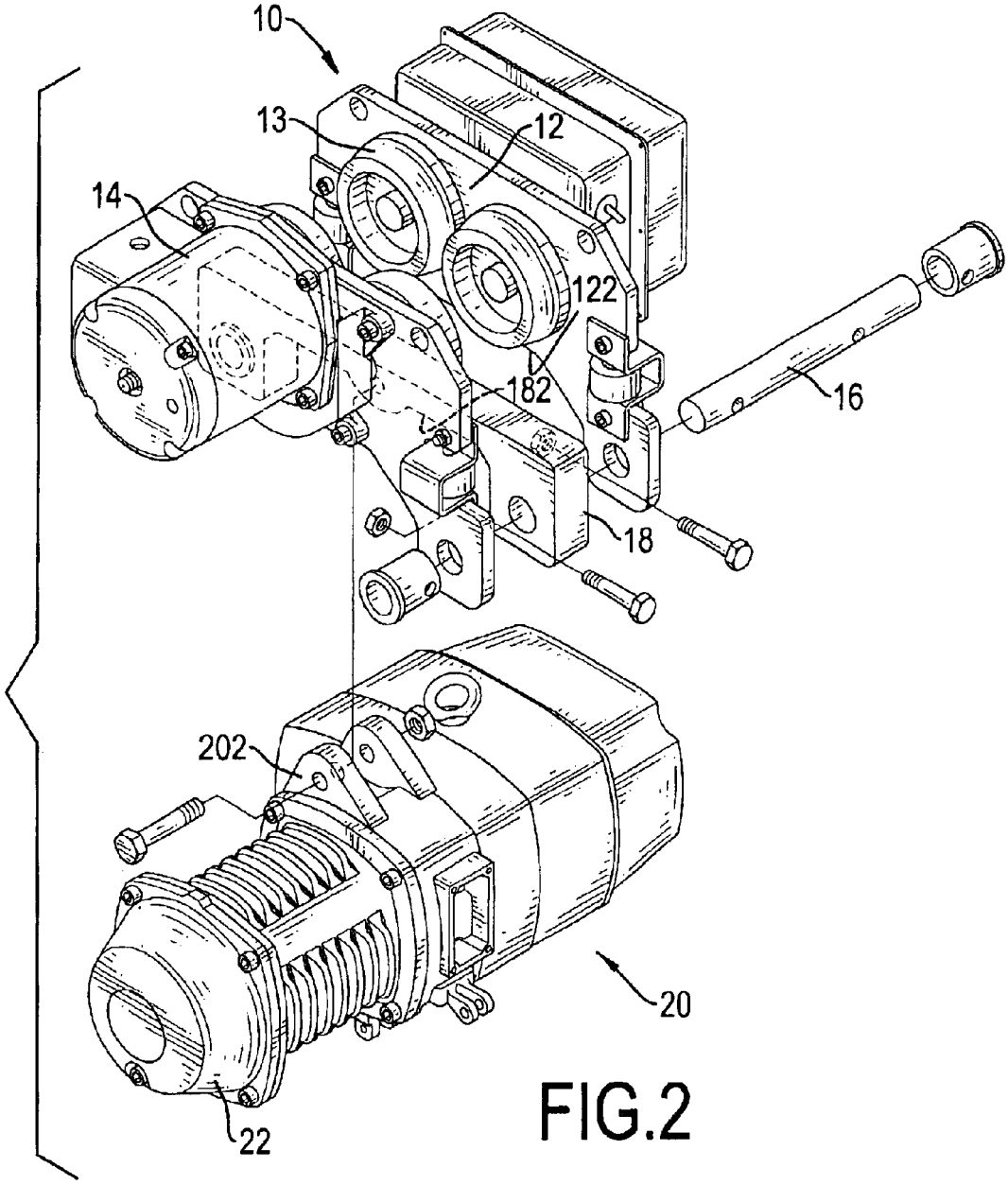
FIG. 2 is an exploded perspective view of the crane assembly in FIG. 1.
Figure 3:
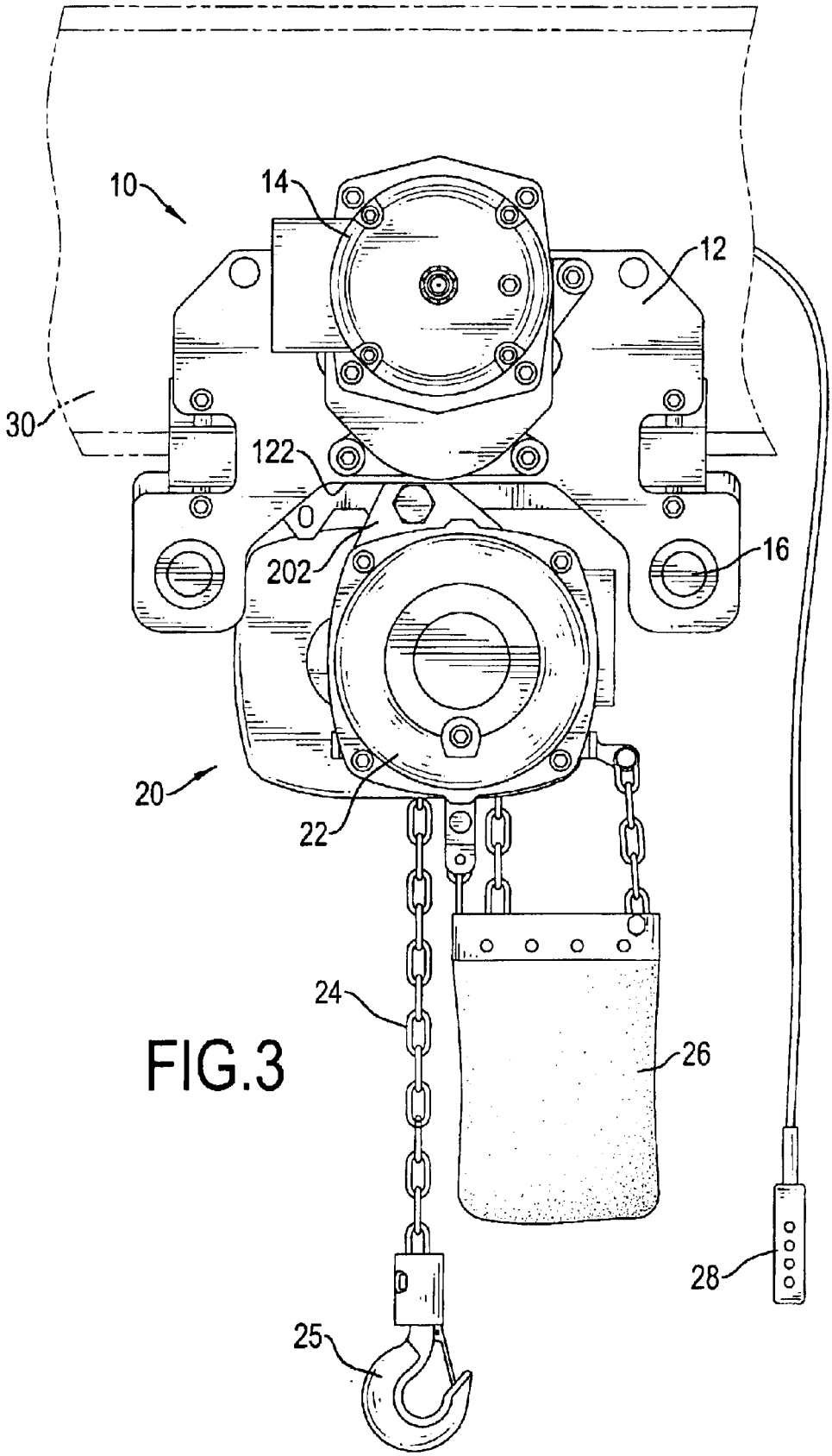
FIG. 3 is a side plan view of the crane assembly in FIG. 1.

With reference to FIGS. 1 to 3, a crane assembly in accordance with the present invention comprises a bracket (10), a supporting plate (18), a crane device (20), a chain (24) and a chain bag (26). The bracket (10) is movably mounted on a rail (30) and has two side plates (12). The side plates (12) are connected with each other and each has a bottom, an inner side facing to the inner side of the other side plate (12) and an outer side. Each respective side plate (12) has a first recess (122) defined in the bottom of the side plate (12) and corresponding to the first recess (122) in the other side plate (12) to make the side plate (12) have an inverse U-shape. Two axles (16) are mounted between the side plates (12) and are respectively located at two sides of the first recesses (122) in the side plates (12) to combine the side plates (12) together. Two wheels (13) are rotatably attached to the inner side of each respective side plate (12) and abut the rail (30). A first driving device (14) is attached to the outer side of one of the side plates (12) and is connected to the wheels (13) on the side plate (12) on which the first driving device (14) is mounted. In practice, the first driving device (14) is a motor. When the driving device (14) is switched on, the wheels (13) will be actuated to rotate so as to make the bracket (10) move along the rail (30).

The supporting plate (18) is attached to the axles (16) and is mounted between the side plates (12). A second recess (182) is defined in the bottom of the supporting plate (18) and corresponds to the first recesses (122) in the side plates (12). The axles (16) extend through the supporting plate (18) respectively at two sides of the second recess (182) so as to attach the supporting plate (18) to the side plates (12).

The craning device (20) is pivotally attached to the supporting plate (18) and has a top portion received in the first recesses (122) in the side plates (12) and the second recess (182) in the supporting plate (18). The craning device (20) comprises a housing (not numbered), a second driving device (22) and a craning mechanism (not shown). The housing is pivotally attached to the supporting plate (18) and has a top partially received in the first recesses (122) in the side plates (12) and the second recess (182) in the supporting plate (18). Two parallel ears (202) protrude from the top of the housing to sandwich the supporting plate (18) between the ears (202). A pivotal pin (not numbered) penetrates through the ears (202) and the supporting plate (18) so as to pivotally attach the housing to the supporting plate (18).

The second driving device (22) is attached to one end of the housing. In practice, the second driving device (22) is a motor. The craning mechanism is received in the housing and is connected to and actuated by the second driving device (22).

The chain (24) extends through the housing and is connected to and driven by the craning mechanism. One end of the chain (24) is provided with a hook (25), and the other end of the chain (24) is received in the chain bag (26) that is attached to the bracket (10). Additionally, the crane assembly further comprises a control (28) electrically connected to the first and the second driving devices (14,22) to control the actions of the driving devices (14,22). Wherein, the structures of the craning mechanism, the chain (24), the chain bag (26) and the controller (28) are same as those of the conventional and are not further described.

Figure 4:
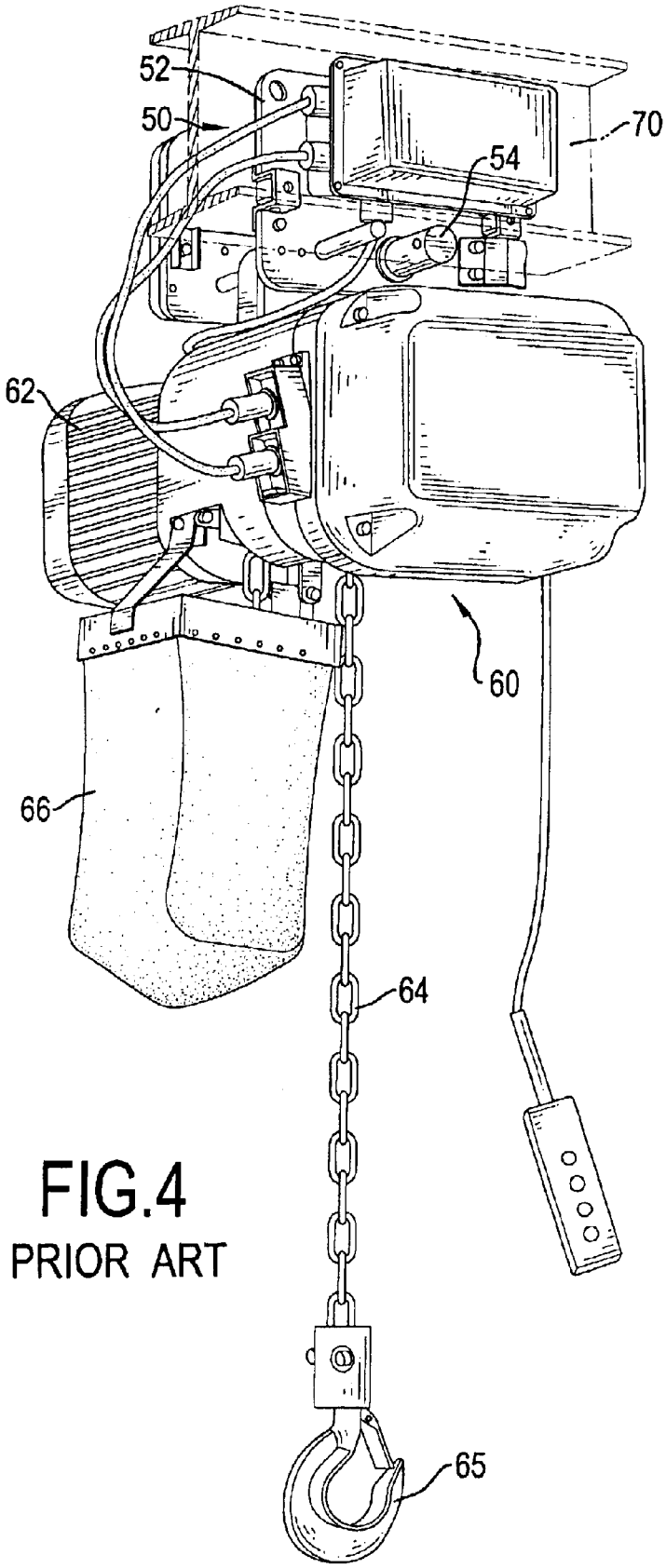
FIG.4 PRIOR ART
FIG. 4 is a perspective view of a conventional crane assembly in accordance with the prior art.
Figure 5:
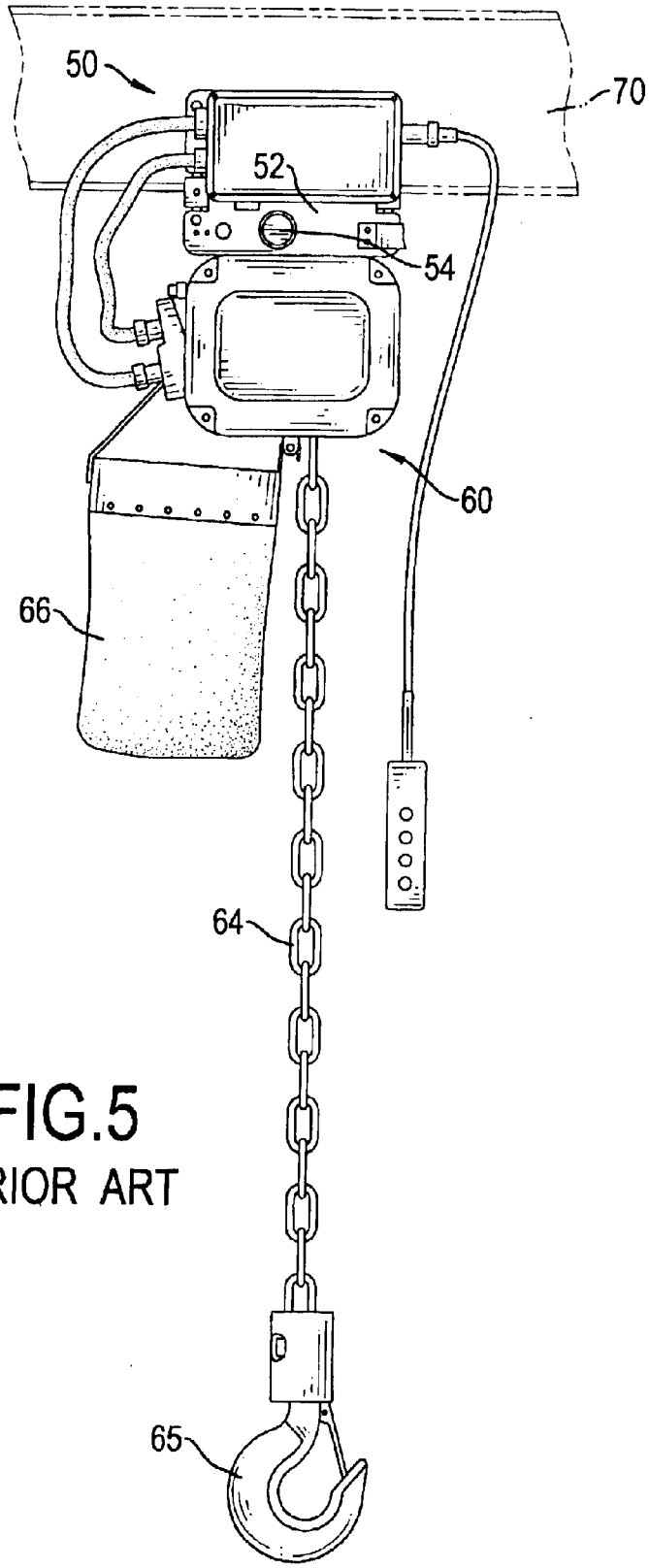
FIG.5 PRIOR ART
FIG. 5 is a side plan view of the conventional crane assembly in FIG. 4.

With such a crane assembly, because part of the housing of the crane device (20) is received in the recesses (122,182) in the side plates (12) and the supporting plate (18), the location of the crane device (20) relative to a rail (30) is higher than that of the crane device (60) of the conventional crane assembly, as shown in FIG. 4, which is mounted on the same rail (30). Consequently, the craning travel of the chain (24) is lengthened, and the use of the present crane assembly is more efficient and versatile than the conventional one.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A crane assembly comprising:

a bracket adapted to move along a rail and comprising:

two side plates connected with each other and each having a bottom, an inner side facing to the inner side of the other side plate and an outer side;

a first recess defined in the bottom of each respective side plate and corresponding to the first recess in the other side plate to form the side plate as an inverse U-shape;

two axles mounted between the side plates and respectively located at two sides of the first recesses in the side plates to combine the side plates together;

at least one wheel rotatably attached to the inner side of each respective side plate; and a first driving device attached to the outer side of one of the side plates and connected to the at least one wheel on the side plate on which the first driving device is mounted;

a supporting plate attached to the axles and mounted between the side plates;

a craning device pivotally attached to the supporting plate and having a top portion received in the first recesses in the side plates, the craning device comprising:

a housing having a top partially received in the first recesses in the side plates;

a second driving device attached to one end of the housing; and a craning mechanism received in the housing and connected to and actuated by the second driving device;

a chain extending through the housing and connected to and driven by the craning mechanism, the chain having a first end provided with a hook and a second end; and a chain bag attached to the bracket for receiving the second end of the chain.

2. The crane assembly as claimed in claim 1, wherein the supporting plate has a bottom and a second recess defined in the bottom of the supporting plate and corresponding to the first recesses in the side plates; and the top of the housing of the craning device is partially received in the second recess in the supporting plate.

3. The crane assembly as claimed in claim 2, wherein the axles respectively extend through the supporting plate at two sides of the second recess.

4. The crane assembly as claimed in claim 3, wherein the housing of the craning device has two parallel ears protruding from the top of the housing to sandwich the supporting plate between the ears; and a pivotal pin penetrates through the ears and the supporting plate to pivotally attach the housing to the supporting plate.

5. The crane assembly as claimed in claim 1 further comprising a control electrically connected to the first and the second driving devices.

* * * * *